US006203007B1

(12) United States Patent
Choi

(10) Patent No.: US 6,203,007 B1
(45) Date of Patent: Mar. 20, 2001

(54) PAPER DISCHARGING MECHANISM FOR AN IMAGE PROCESSING APPARATUS

(75) Inventor: Bong-Hwan Choi, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/212,296

(22) Filed: Dec. 16, 1998

(51) Int. Cl.[7] ..... B65H 29/00

(52) U.S. Cl. ..... 271/278; 271/184; 271/225; 271/291

(58) Field of Search ..... 271/186, 291, 271/8.1, 225, 287, 184, 303

(56) References Cited

U.S. PATENT DOCUMENTS

| | | | | |
|---|---|---|---|---|
| 4,252,309 | | 2/1981 | Garrison et al. | 271/186 |
| 4,712,785 | | 12/1987 | Stemle | 271/187 |
| 4,890,826 | * | 1/1990 | Rutishauser | 271/296 |
| 5,026,036 | | 6/1991 | Takahashi | 271/3.1 |
| 5,183,249 | | 2/1993 | Ichikawa | 271/186 |
| 5,537,196 | | 7/1996 | Matsumoto et al. | 355/320 |
| 5,549,292 | | 8/1996 | Plain | 271/291 |
| 5,692,740 | | 12/1997 | Holtje | 270/58.01 |

* cited by examiner

*Primary Examiner*—Donald P. Walsh
*Assistant Examiner*—Mark J Beauchaine
(74) *Attorney, Agent, or Firm*—Robert E. Bushnell, Esq.

(57) ABSTRACT

A discharge mechanism capable of discharging a sheet facedown is advantageous to miniaturization of a duplex printing apparatus. The discharge mechanism includes a discharge roller gear engaged with a driving gear; a pair of discharge rollers rotatable by the discharge roller gear, keeping in contact with each other; a disklike support member having a shaft fixed on a same line of a shaft of the driving gear, intervening between the driving gear and the discharge rollers; a friction disk attached to the discharge roller gear, for transferring a driving force of the driving gear to the disklike support member; a compression coil spring interposed between the friction disk and the disklike support member, a shaft of a selected one of the discharge rollers passing through the compressing coil spring; and a solenoid for restricting rotation of the disklike support member when unactuated and for allowing rotation of the disklike support member when supplied with a current. The disklike support member has a pair of opposite stoppers formed at its outer circumference. Each of the stoppers has two opposite protrusions, one of which has a perpendicular outer wall, another of which has a slope.

14 Claims, 5 Drawing Sheets

FIG. 1 *(Related Art)*

PAPER DISCHARGING MECHANISM FOR AN IMAGE PROCESSING APPARATUS

CLAIM OF PRIORITY

This application makes reference to, incorporates the same herein, and claims all benefits accruing under 35 U.S.C. §119 from an application for DISCHARGE MECHANISM IN DUPLEX PRINTING APPARATUS earlier filed in the Korean Industrial Property Office on Dec. 16, 1997 and there duly assigned Ser. No. 69208/1997.

1. Field of the Invention

The present invention relates to an electrophotographic duplex printing apparatus, and in particular, to a discharge mechanism for discharging sheets facedown.

2. Description of the Related Art

Electrophotographic image forming apparatuses include an optical copier, a digital copier, an LBP (Laser Beam Printer) and a facsimile. Among these apparatuses, the LBP and the copier may have a duplex printing function. An apparatus having the duplex printing function is called a duplex printing apparatus. A user of the duplex printing apparatus can select one of simplex and duplex printing modes at the discretion of the user.

Of concern is the ability of an apparatus to discharge duplex printed paper so that the first side printed on comes out of the machine face down. This may require a device for inverting a sheet of paper upon discharge. U.S. Pat. No. 4,712,785 to Stemmle discloses one such mechanism. It is noted that in Stemmle that a sheet diverter and two different paths are required depending on if the device is to invert a sheet or not invert a sheet of paper. U.S. Pat. No. 4,252,309 discloses a document flipper that automatically flips or inverts a sheet of paper. However, such a device does not allow for passage of a sheet of paper without inverting.

What is needed is a compact and simple device that can either invert a sheet of paper or allow a sheet of paper to pass non-inverted.

The following patents each discloses the features in common with the present invention: U.S. Pat. No. 5,026,036 to Takahashi, entitled Device For Controlling Stacking Of Paper Sheets On An Intermediate Tray Of An Image Forming Apparatus, U.S. Pat. No. 4,252,309 to Garrison et al. entitled Document Sheet Flipper, U.S. Pat. No. 4,712,785 to Stemmle, entitled Sheet Stacking Apparatus, U.S. Pat. No. 5,692,740 to Holtje, entitled Disk Type Inverter-Stacker With Improved Sheet Control With Automatically Repositionable Fingers, U.S. Pat. No. 5,183,249 to Ichikawa, entitled Paper Conveyor, U.S. Pat. No. 5,549,292 to Plain, entitled Sheet Stacking And Reversing Separator, U.S. Pat. No. 5,537,196 to Matsumoto, et al. entitled Imaging Apparatus Equipped with Automatic Recirculating Document Handler, and Sheet-Circulating Feeder.

SUMMARY OF THE INVENTION

It is therefore an object of the present invention to provide a discharge mechanism which is advantageous to miniaturization of a duplex printing apparatus.

It is another object of the present invention to provide a discharge mechanism capable of discharging a sheet with the side first printed on facedown.

It is yet another object of the present invention to provide a device that can allow a sheet of paper to pass uninverted or to invert a sheet of paper upon passing.

It is still another object of the present invention to provide a discharge mechanism enabling a duplex printing apparatus to match the order of pages printed by an organic photoconductive drum with the order of print pages provided from a computer.

To achieve the above object, a discharge mechanism in a duplex printing apparatus having a driving gear includes a discharge roller gear engaged with the driving gear; a pair of discharge rollers rotatable by the discharge roller gear, the discharge rollers keeping in contact with each other; a disklike support member having a shaft fixed on a same line of a shaft of the driving gear, intervening between the driving gear and the discharge rollers; a friction disk attached to the discharge roller gear, for transferring a driving force of the driving gear to the disklike support member; a compression coil spring interposed between the friction disk and the disklike support member, a shaft of a selected one of the discharge rollers passing through the compressing coil spring; and a solenoid for restricting rotation of the disklike support member when supplied with a current.

The disklike support member has a pair of opposite stoppers formed at outer circumference. Each of the stoppers has two opposite protrusions, one of which has a perpendicular outer wall, another of which has a slope.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
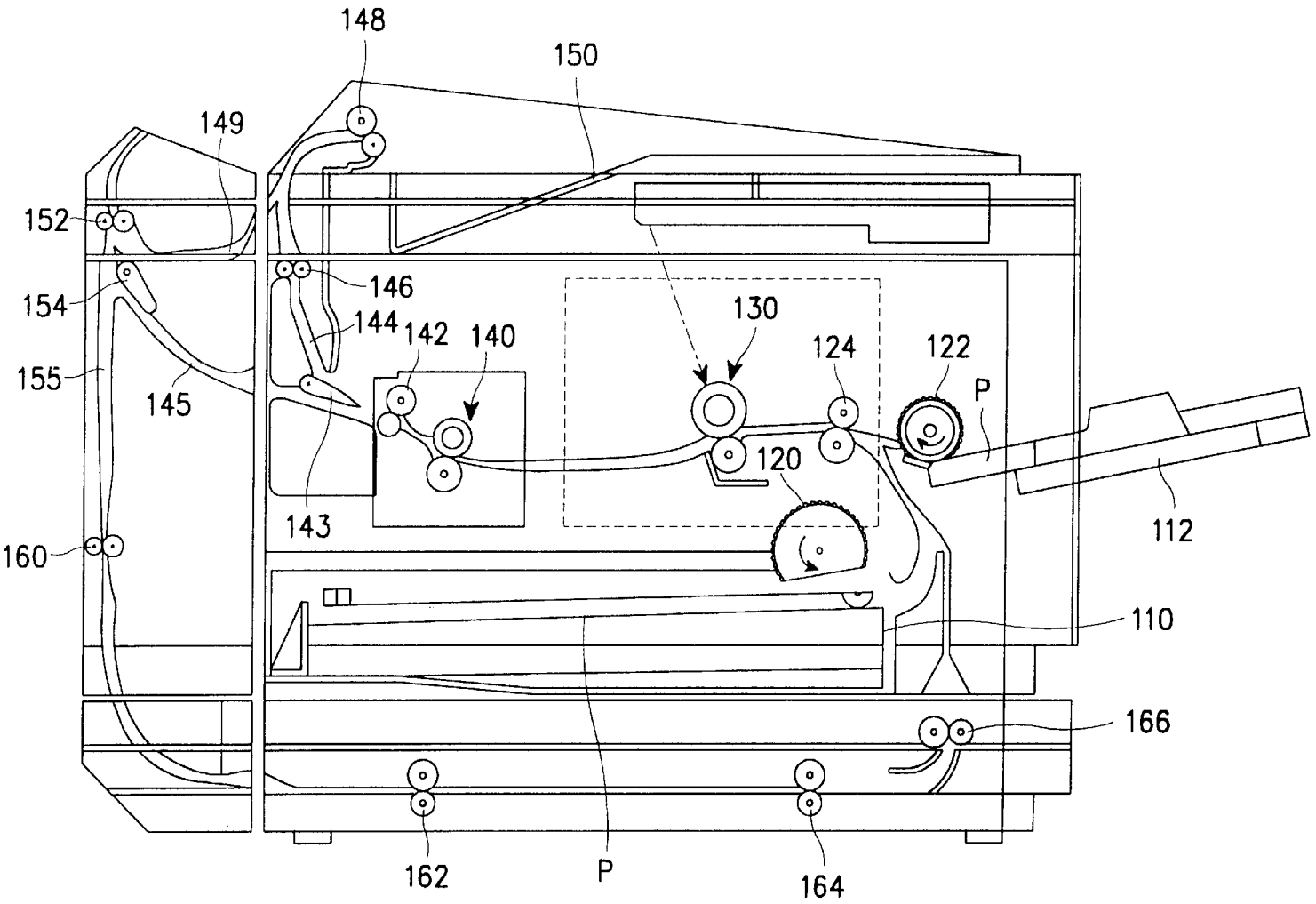
FIG. 1 is a side view of a duplex printing apparatus with a known discharge mechanism.

Referring to FIG. 1, the duplex printing apparatus has a simplex printing mode and a duplex printing mode. In the simplex printing mode, an uppermost sheet P in sheet cassette 110 or 112 is transferred to aligning rollers 124 by a pickup roller 120 or 122 and undepicted fingers. As the sheet whose leading end is aligned by the aligning rollers 124, passes through a developing unit 130 and a fixing unit 140, a toner image is printed on a front surface 2 of the sheet. The sheet is guided to a sheet path 144 by a lever 143 and conveying rollers 142. Subsequently, the sheet is discharged to a discharge tray 150 by conveying rollers 146 and discharge rollers 148. Here, the sheet is delivered to the discharge tray 150 facedown. The sheet path guiding lever 143 is controlled by a undepicted optical sensor, which may be positioned between the lever 143 and the conveying rollers 142 to detect a leading end of the sheet. Further, it should be noted that the front surface (i.e., upper surface) of the sheet is represented by reference numeral 2 and a back surface (i.e., lower surface) of the sheet is represented by reference numeral 1.

In the duplex printing mode, the uppermost sheet P in one of the sheet cassettes 110 and 112 is transferred to the aligning rollers 124 by the associated pickup roller and the undepicted fingers. Thereafter, the upper surface (i.e., front surface) 2 of the sheet is first printed while passing through the developing unit 130 and the fixing unit 140. Here, the sheet path guiding lever 143 moves up in response to a sheet detection signal from the undepicted optical sensor, to guide the sheet to a sheet path 145. Subsequently, the sheet passes through discharge rollers 152 until a rear end of the sheet is detected by an optical sensor which may be positioned between a lever 154 and the discharge rollers 152. When the rear end of the sheet is detected, the discharge rollers 152 rotate reversely to forward the sheet to a sheet path 155. The sheet is again transferred to the aligning rollers 124 by a plurality of conveying rollers 160, 162, 164 and 166. Then, the lower surface (i.e., the back surface) 1 of the sheet is printed while passing through the developing unit 130 and the fixing unit 140. The sheet is guided to the sheet path 145 by the lever 143 and proceeds to the discharge rollers 152 until the rear end of the sheet is detected. When the rear end of the sheet is detected, the lever 154 blocks up the sheet path 155 and the discharge rollers 152 rotate reversely to forward the sheet to a sheet path 149. Finally, the sheet is discharged to the discharge tray 150 by discharge rollers 148. Here, the upper surface 2 of the sheet is placed on the discharge tray 150 facedown.

To increase an efficiency of a memory and reduce a printing time, the duplex printing apparatus feeds the sheets in succession, prints them in the page order of 1, 3, 2, 5, 4, 7, 6, 9 . . . , and stacks them on the discharge tray 150 facedown. To this end, the printing apparatus includes the sheet path 149 for reversing the sheet and the lever 154 separately, which makes the apparatus complex in structure and large in size. Therefore, the duplexing printing apparatus cannot match the order of pages printed by an organic photoconductive (OPC) drum 130 in the developing unit with the order of print pages provided from a computer, resulting in extra software and hardware to keep tract of the page order.

Figure 2:
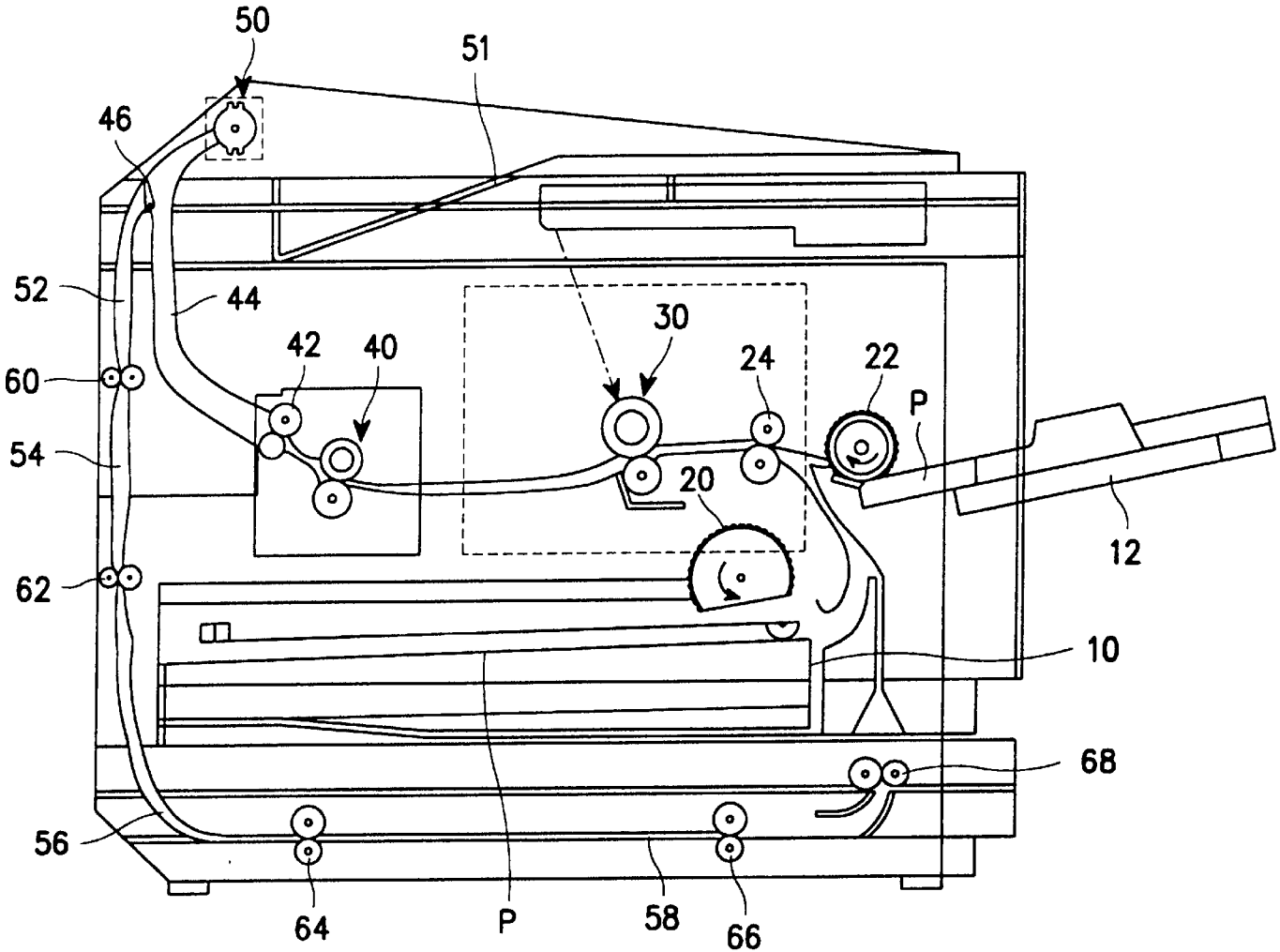
FIG. 2 is a side view of a duplex printing apparatus with a discharge mechanism according to an embodiment of the present invention.

Referring to FIG. 2, a duplex printing apparatus includes a discharge mechanism 50 according to an embodiment of the present invention. The discharge mechanism 50 is disposed in front of a discharge tray 51. The discharge mechanism 50 is well illustrated in FIG. 3.

Figure 3:
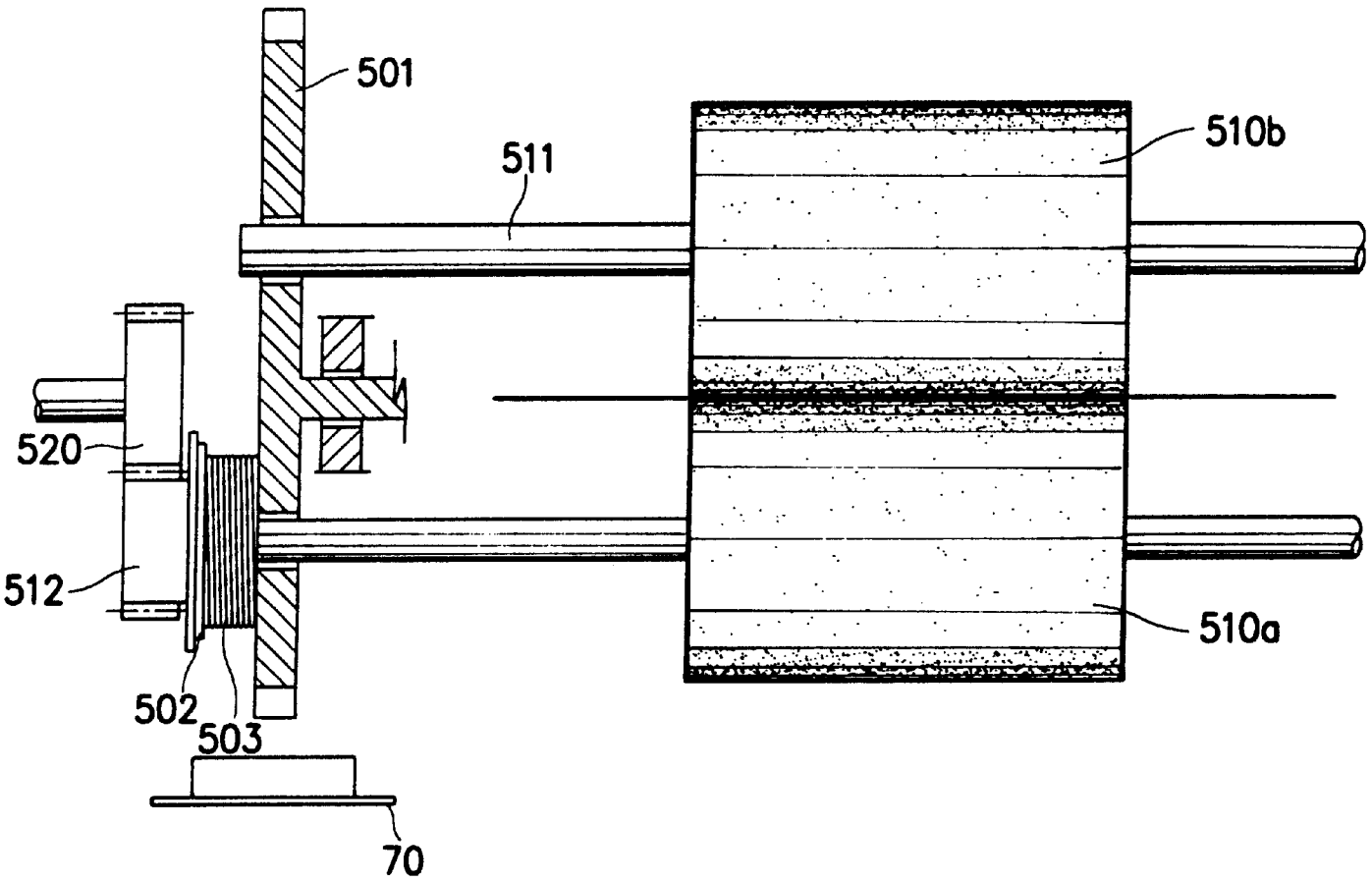
FIG. 3 is a front view of the discharge mechanism (50) of FIG. 2.
Figure 4A:
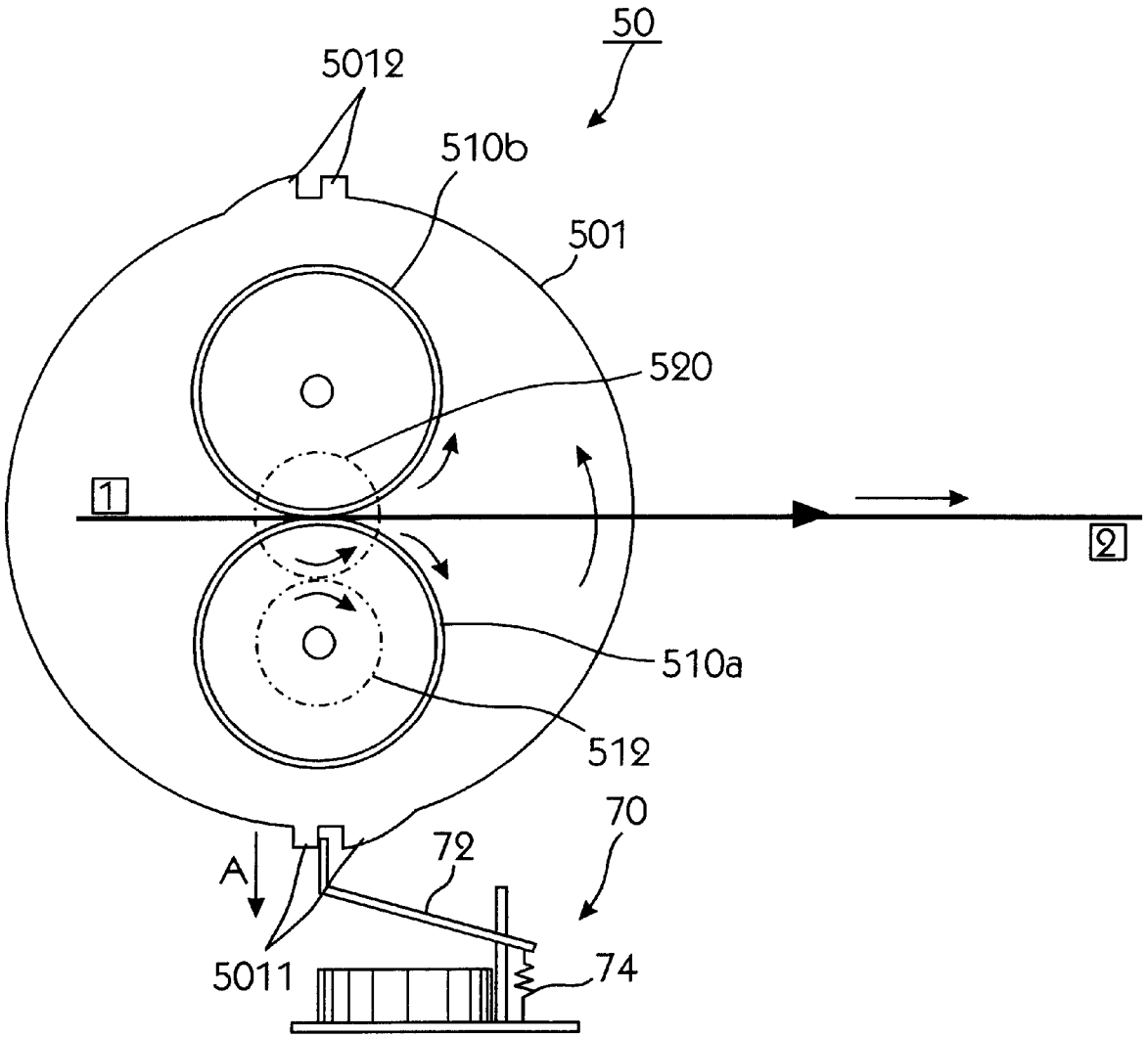
FIG. 4A is a side view of the discharge mechanism (50) of FIG. 2, for explaining a state where the discharge mechanism operates in a simplex printing mode.
Figure 4B:
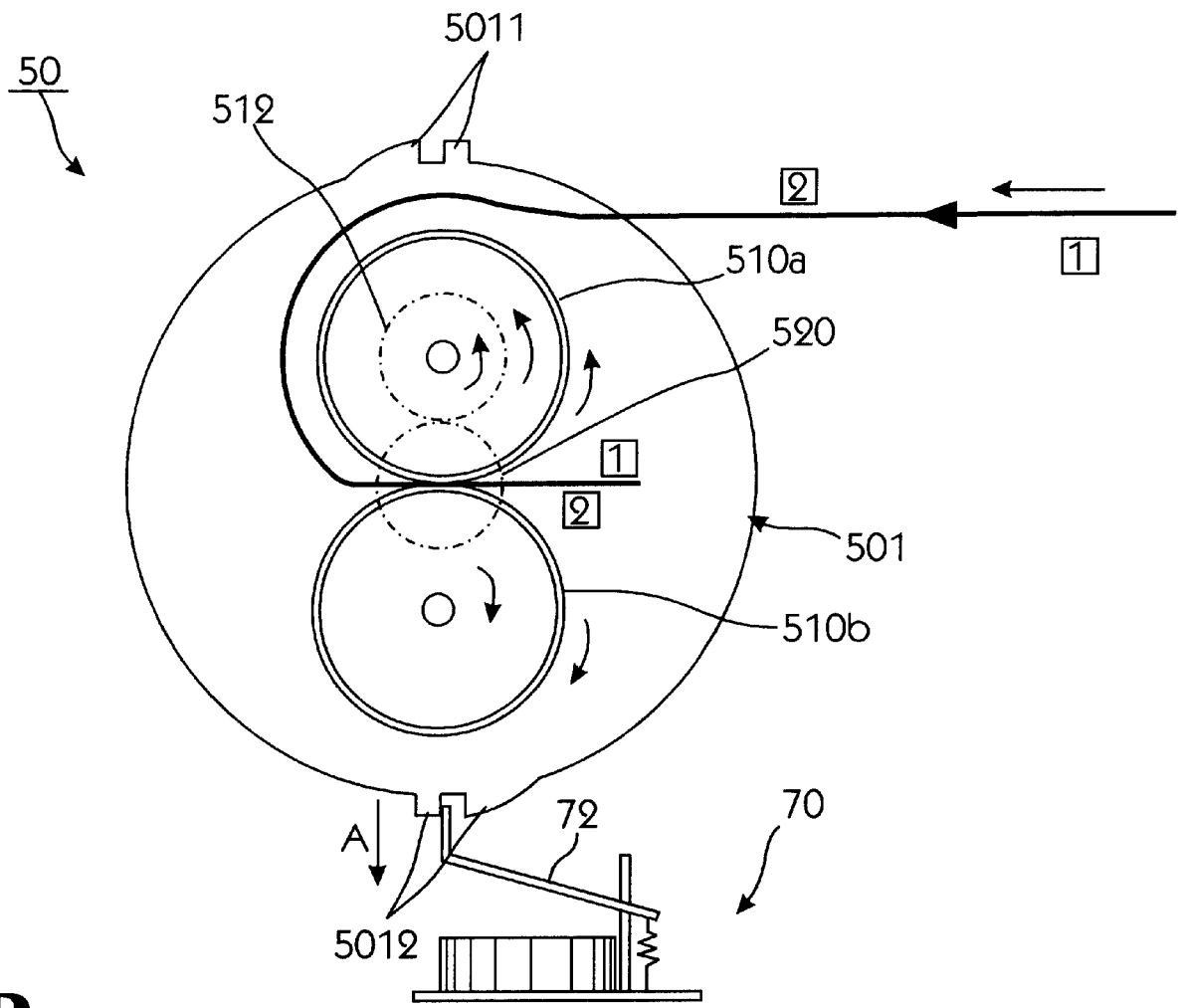
FIG. 4B is a side view of the discharge mechanism (50) of FIG. 2, for explaining a state where the discharge mechanism operates in a duplex printing mode.

Referring to FIGS. 3 to 4B, the discharge mechanism 50 includes a pair of discharge rollers 510*a* and 510*b*; a driving gear 520 engaged with a discharge roller gear 512, for providing a driving force to the discharge roller gear 512 of the discharge roller 510*a*; a disklike support member 501 fixed to a frame, intervening between the roller gear 512 and the discharge rollers 510*a* and 510*b*, the disklike support member 501 having a shaft fixed on the same line as a shaft of the driving gear 520; a solenoid 70 for restricting rotation of the disklike support member 501 when unactuated and for allowing rotation of the disklike support member when provided with a current; a friction disk 502 attached to one side of the discharge roller gear 512; and a compression coil spring 503 intervening between the friction disk 502 and the disklike support member 501. Each discharge roller has one shaft 511. The shaft 511 of the discharge roller 510*a* passes through the compression coil spring 503. The respective elements of the discharge mechanism 50 are interlocked with one another.

In operation, as the driving gear 520 rotates, the discharge roller gear 512 engaged with the driving gear 520 rotates the discharge roller 510*a*. Here, the disklike support member 501 is normally restrained by an actuator 72 of the solenoid 70 so that the disklike support member 501 is unable to rotate. Accordingly, the discharge rollers 510*a* and 510*b* rotate to discharge the sheet. In the meantime, when the solenoid 70 is provided with a current in response to a sheet end detection signal from the optical sensor (not shown) which is positioned between the lever 46 and the discharge mechanism 50, the actuator 72 contacts the solenoid 70 so that the disklike support member 501 is released from the solenoid 70. Therefore, as the driving gear 520 rotates to discharge the sheet facedown, the discharge roller gear 512 and the disklike support member 501 both rotate by the friction disk 502 and an elastic force of the compression coil spring 503. Since the shaft of the driving gear 520 is fixed to the frame and a shaft of the discharge roller gear 512 is not fixed to the frame, the discharge roller gear 512 rolls about on the driving gear 520. Here, the disklike support member 501 rotates by about 180° and then, is restrained again by stoppers 5011 and 5012 formed at the outer circumference thereof. Each of the stoppers 5011 and 5012 has two opposite protrusions, one of which has a perpendicular outer wall, another of which has a slope.

Referring back to FIG. 2, in a simplex printing mode, a uppermost sheet P piled in one of sheet cassettes 10 and 12 is transferred to aligning rollers 24 by a pickup roller 20 or 22 and undepicted fingers. As the sheet whose leading end is aligned by the aligning rollers 24, passes through a developing unit 30 and a fixing unit 40, a toner image is fixed to a front surface (i.e., upper surface) 2 of the sheet by the heat and pressure of a heat roller and a pressure roller. The sheet then proceeds to the discharge mechanism 50 along a sheet path 44, being guided by a sheet path guiding lever 46. Finally, the sheet is discharged to the discharge tray 51 facedown by the discharge mechanism 50.

In a duplex printing mode, the discharge mechanism 50 operates in a different way. The uppermost sheet piled in one of the sheet cassettes 10 and 12 is fed by the associated pickup roller and the undepicted fingers. Subsequently, the fed sheet is aligned by the aligning rollers 24 and passes through the developing unit 30 and the fixing unit 40, during which the toner image is fixed to the upper surface (i.e., front surface) 2 of the sheet by the heat and pressure of the heat roller and the pressure roller. Thereafter, the sheet proceeds to the discharge mechanism 50 along the sheet path 44 by the conveying rollers 42. In the meantime, when the undepicted optical sensor disposed between the lever 46 and the discharge mechanism 50 detects the rear end of the sheet, the discharge mechanism 50 rotates reversely and the lever 46 moves to close the sheet path 44 so that the sheet may proceed along the sheet path 52. After the front surface of the sheet is printed in this manner, the sheet proceeds to the aligning rollers 24 again along sheet paths 54, 56 and 58 by conveying rollers 60, 62, 64, 66 and 68. As the sheet passes again through the developing unit 30 and the fixing unit 40, the toner image is printed on the lower surface (i.e., back surface) 1 of the sheet, thereby completing the duplex printing. After completion of duplex printing, the leading end of the sheet reaches the discharge mechanism 50 along the sheet path 44.

Now, reference will be made to operation of the discharge mechanism 50 with reference to FIGS. 4A and 4B. The discharge mechanism 50 is so designed as to discharge the upper surface 2 of the sheet facedown.

FIG. 4A illustrates a state where the discharge mechanism 50 operates in the simplex printing mode, wherein the disklike support member 501 is restrained by the solenoid 70. Specifically, the stopper 5011 protruding out from the outer circumference of the disklike support member 501 is hooked by the actuator 72 of the solenoid 70 so that the disklike support member 501 is unable to rotate. That is, as the driving gear 520 rotates, the discharge roller gear 512 engaged with the driving gear 520 rotates the discharge rollers 510*a* and 510*b*.

However, in the duplex printing mode, while the leading end of the sheet reaches the discharge mechanism 50 and progresses between discharge rollers 510*a* and 510*b*, if the optical sensor disposed between the lever 46 and the discharge mechanism 50 detects the rear end of the sheet, a current is provided to the solenoid 70 so that the actuator 72 supported by a tension coil spring 74 may move in the direction of arrow A and contact the solenoid 70 to release the disklike support member 501.

Then, as illustrated in FIG. 4B, the disklike support member 501 rotates counterclockwise (in an arrow direction) by the friction disk 502 and the compression coil spring 503. The disklike support member 501 rotates by about 180° and stops again by the actuator 72 of the solenoid 70, as the stopper 5012 is restrained by an end of the actuator 72. While the disklike support member 501 rotates, the end of the actuator 72 makes sliding contact with the outer circumference of the disklike support member 501. When the disklike support member 501 stops rotating by the actuator 72 of the solenoid 70, the discharge rollers 510*a* and 510*b* rotate in a direction opposite to that of FIG. 4A to discharge the sheet to the discharge tray 51 facedown.

It is preferable that at least two discharge mechanisms 50 are placed at either side of the discharge tray 51. As can be appreciated from the foregoing, the novel discharge mechanism contributes to miniaturization of the duplex printing apparatus. Further, as compared with the conventional one, the duplex printing apparatus with the novel discharge mechanism has the total sheet path reduced in length, so that it is possible to print a next page after completion of duplex printing for the present page. Accordingly, the printing apparatus can print the sheets in the order of the print pages provided from the computer, thereby increasing the efficiency of the memory.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A discharge mechanism in a duplex printing apparatus including a driving gear, comprising:

a discharge roller gear engaged with the driving gear;

a pair of discharge rollers rotatable by the discharge roller gear, keeping in contact with each other;

a disklike support member having a shaft fixed on a same line of a shaft of the driving gear, intervening between the driving gear and the discharge rollers;

a friction disk attached to the discharge roller gear, for transferring a driving force of the driving gear to the disklike support member;

a compression coil spring interposed between the friction disk and the disklike support member, a shaft of a selected one of the discharge rollers passing through the compressing coil spring; and a solenoid for restricting rotation of the disklike support member when unactuated and for allowing the disklike member to rotate when supplied with a current.

2. The discharge mechanism as claimed in claim 1, wherein said disklike support member has a pair of opposite stoppers formed at its outer circumference.

3. The discharge mechanism as claimed in claim 2, wherein each of said stoppers has two opposite protrusions, one of which has a perpendicular outer wall, another of which has a slope.

4. A discharge mechanism in a duplex apparatus, comprising:

a pair of discharge rollers forming a nip between them, each of said pair of discharge rollers rotating about a shaft; and a disklike support member attached to said shafts of said pair of discharge rollers, each one of said pair of shafts intersecting said disklike support member at separate points on said disklike support member at opposite sides of a center point of said disklike support member, wherein said disklike support member is capable of rotating, causing the shafts of said discharge rollers to change positions, said disklike support member rotating about said center point.

5. The discharge mechanism of claim 4, wherein said disklike support member rotates 180 degrees about said center point for sheet inversion.

6. The discharge mechanism of claim 5, wherein said disklike support member contains a pair of notches disposed on the outer circumference thereof 180 degrees apart, into which a lever is inserted to prevent further rotation of said disklike support member.

7. The discharge mechanism of claim 6, further comprising:

a discharge roller gear disposed on the shaft of one of said pair of discharge rollers; and a driving gear that drives both said discharge roller gear and said disklike support member.

8. The discharge mechanism of claim 7, wherein the axis of said driving gear coincides with the axis and the center point of said disklike support member and said nip formed between said pair of discharge rollers.

9. The discharge mechanism of claim 8, further comprising a solenoid for controlling the rotation of said disklike support member by manipulating said lever capable of being inserted into one of said pair of notches on said disklike support member.

10. The discharge mechanism of claim 9, further comprising a friction disk being attached to said discharge roller gear, for transferring a driving force of the driving gear to the disklike support member.

11. The discharge mechanism of claim 10, further comprising a compression coil spring interposed between said friction disk and the disklike support member, said shaft of one of said pair of discharge rollers passing through the compressing coil spring.

12. A method for discharging a duplex sheet of paper onto a discharge tray, comprising the steps of:

providing a pair of discharge rollers each having a shaft and a disklike support member, said pair of discharge rollers each attached to said disklike support member at said shaft, said shaft of each of said discharge rollers perpendicular to the surface of said disklike support member, said pair of shafts intersecting said disklike support member at separate points on said disklike support member, at opposite sides of a center point of said disklike support member;

conveying said sheet between said pair of discharge rollers, the side last printed on facing down;

halting the rotation of said pair of discharge rollers when said sheet is almost entirely passed through said discharge rollers;

rotating said disklike support member 180 degrees, said discharge rollers and said sheet being attached to said disklike support member;

initiating said pair of rotated discharge rollers to rotate in a reverse direction; and discharging said sheet of paper onto said discharge tray, said side last printed on facing up.

13. The method of discharging a duplex sheet of claim 12, further comprising:

providing a pair of notches disposed on the outer circumference of said disklike support member, said pair of notches being 180 degrees apart from one another;

providing a lever that can be locked into each one of said pair of notches;

disengaging said lever from one of said pair of notches;

rotating said disklike support member 180 degrees; and engaging into place said lever into said other of said pair of notches.

14. The method of discharging a duplex sheet of claim 13, further comprising:

activating a solenoid to disengage and engage said notches on said disklike support member.

* * * * *